United States Patent [19]

Hanson et al.

[11] 4,409,090

[45] * Oct. 11, 1983

[54] PROCESS FOR RECOVERING PRODUCTS FROM TAR SAND

[75] Inventors: Francis V. Hanson; Jan D. Miller; Alex G. Oblad, all of Salt Lake City, Utah

[73] Assignee: University of Utah, Salt Lake City, Utah

[ * ] Notice: The portion of the term of this patent subsequent to Jun. 29, 1999 has been disclaimed.

[21] Appl. No.: 344,324

[22] Filed: Feb. 1, 1982

Related U.S. Application Data

[63] Continuation-in-part of Ser. No. 155,257, Jun. 2, 1980, Pat. No. 4,337,143.

[51] Int. Cl.[3] ..... C10G 1/04

[52] U.S. Cl. ..... 208/11 LE; 208/11 R

[58] Field of Search ..... 208/11 LE, 11 R

[56] References Cited

U.S. PATENT DOCUMENTS

| | | | |
|---|---|---|---|
| 3,261,775 | 7/1966 | Blaser | 208/11 R |
| 3,320,152 | 5/1967 | Nathan | 208/11 R |
| 3,466,240 | 9/1969 | Steinmetz | 208/11 LE |
| 3,518,181 | 6/1970 | Tse | 208/11 R |
| 4,120,776 | 10/1978 | Miller | 208/11 LE |
| 4,161,442 | 7/1979 | Audeh | 208/11 LE |
| 4,337,143 | 6/1982 | Hanson et al. | 208/11 R |

FOREIGN PATENT DOCUMENTS

| | | | |
|---|---|---|---|
| 530920 | 9/1956 | Canada | 208/11 R |

*Primary Examiner*—Delbert E. Gantz
*Assistant Examiner*—A. Pal
*Attorney, Agent, or Firm*—H. Ross Workman; Allen R. Jensen; Dale E. Hulse

[57] ABSTRACT

A combination physical separation process and thermal fluidized bed process for recovering products from tar sands. The process includes initially separating a portion of the sand from the tar sand through a physical separation process, yielding a bitumen-rich concentrate. The bitumen-rich concentrate is introduced into a heated fluidized bed and products are recovered and distilled into their respective fractions. A coked sand is removed from the fluidized bed and placed into a combustor where the carbonaceous residue on the sand is burned to produce a hot burnt sand, a portion of which may be recycled to provide heat to the bitumen-rich concentrate in the fluidized bed. The coked sand and a certain fraction of the distilled products may be recycled to the physical separation process to improve the separation efficiency thereof.

30 Claims, 2 Drawing Figures

PROCESS FOR RECOVERING PRODUCTS FROM TAR SAND

RELATED APPLICATIONS

This application is a continuation-in-part application of our copending application, Ser. No. 155,257, filed June 2, 1980 entitled "PROCESS FOR OBTAINING PRODUCTS FROM TAR SAND," now U.S. Pat. No. 4,337,143 which is incorporated herein by reference.

BACKGROUND

1. Field of the Invention

The present invention relates to a process for recovering products from tar sand, and more particularly, to a combination physical separation process and thermal fluidized bed process for recovering products from the tar sand.

2. The Prior Art

Tar Sands—General Discussion

The term "tar sand" refers to a consolidated mixture of bitumen (commonly referred to as "tar") and sand. Other names used to describe tar sands include "oil sands" and "bituminous sands"—the latter term being more technically correct in that it provides a more accurate description of the mixture. X-ray diffraction patterns reveal that the sand constituent of tar sand is mostly alpha quartz, while the bitumen or tar constituent of tar sand consists of a mixture of a variety of hydrocarbons including heterocyclic compounds. After separation of the bitumen from the sand, the bitumen may be upgraded to a synthetic crude oil suitable for use as a feedstock for the production of such materials as liquid motor fuels, heating oil, and petrochemicals.

About sixty-five percent (65%) of all of the known oil in the world is contained in tar sand deposits or heavy oil deposits. With the exception of the continents of Australia and Antarctica, tar sand fields have been located throughout the world. Significantly, large tar sand deposits have been identified and mapped in Canada, Columbia, Trinidad-Tobago, Venezuela, and the United States. The Canadian tar sand deposits, commonly referred to as the Athabasca tar sands, are located in the province of Alberta, Canada and are currently being developed. It is estimated that the bitumen content in the Athabasca tar sands alone represents approximately 900 billion barrels of bitumen in place.

Analysis of the Athabasca tar sands indicates that these tar sands have an average bitumen content of approximately twelve to thirteen percent (12–13%) by weight. Significantly, the Athabasca tar sands also have a relatively high moisture content of approximately three to five percent (3–5%) by weight connate water. Although not experimentally verified, it is believed by some that the equilibrium structure of the Athabasca tar sands consists of a sand mixed with, but separated from, a bitumen matrix by a film of connate water—the connate water surrounding each grain of sand. It is further believed that the bitumen in the Athabasca tar sands is naturally displaced from the sand grains by the connate water. Whatever the position of the connate water in the Athabasca tar sands, it has been the experience of those skilled in the art that the bitumen phase is readily disengaged from the sand phase by conventional hot water separation techniques.

A more comprehensive discussion of the Athabasca tar sands may be found, for example, in:

(1) E. D. Innes & J. V. D. Tear, "Canada's First Commercial Tar Sand Development," 3 *Proceedings of the Seventh World Petroleum Congress* 633 (Elsevier Publishing Co., 1967);

(2) F. W. Camp, *The Tar Sands of Alberta Canada, Cameron Engineering, Inc., Denver, Colorado* (2d ed. 1974); and (3) J. Leja and C. W. Bowman, "Application of Thermodynamics to the Athabasca Tar Sands," 46 *Canadian Journal of Chemical Engineering* 479 (1968).

In the United States, approximately twenty-four (24) states are presently known to contain tar sand deposits. However, about ninety to ninety-five percent (90–95%) of the mapped tar sand deposits are located within the state of Utah. These Utah tar sands are estimated to represent at least twenty-five (25) billion barrels of synthetic crude oil. Although the Utah tar sand reserves appear small in comparison with the Athabasca tar sand reserves, Utah tar sands represent a significant energy source when compared to the known natural crude oil reserves in the United States (approximately 31 billion barrels).

For the most part, the Utah tar sand reserves are deposited in six major locations along the eastern edge of Utah, with the bitumen content varying from deposit to deposit as well as within a given deposit. Generally, Utah tar sand deposits contain less than ten percent (10%) bitumen by weight, although deposits have been found with higher bitumen content.

Unlike Athabasca tar sands, however, Utah tar sands contain a negligible amount of connate water (much less than one percent (1%) by weight), and are most commonly characterized by a virtual absence of connate water. Indeed, some Utah tar sands have been found to be so dry that no moisture content can be detected by a standard Dean-Stark analysis. In the absence of connate water, the bitumen in the Utah tar sands is directly in contact with and bonded to the surface of the sand grains.

Moreover, tests have determined that the bitumen in Utah tar sands is at least ten times, and often as much as a thousand times, more viscous than the bitumen in Athabasca tar sands. (See FIG. 1 for an Arrhenius-type plot illustrating the effect of temperature on the bitumen viscosity in both Utah and Athabasca tar sands). Indeed, certain Utah tar sand samples taken from an area known as the Tar Sand Triangle have been found to be well over ten thousand times more viscous than the Athabasca tar sands.

In view of the recognized physical and chemical differences between Utah tar sands and Athabasca tar sands, it will be readily appreciated that the processing of Utah tar sands is substantially more difficult than the processing of Athabasca tar sands. The processing of Utah tar sands involves two fundamental steps: (1) displacing the bonded bitumen from the sand grains, and (2) disengaging the viscous bitumen phase from the residual sand phase. It may be that the processing of Athabasca tar sands merely involves disengaging the relatively less viscous bitumen phase from the sand phase, since the bitumen may already be displaced from the sand by a film of connate water. However the connate water and the relatively less viscous bitumen in the Athabasca tar sands might function to facilitate the separation of the bitumen from the sand, it is clear that the processing of the Athabasca tar sands substantially easier than the processing of Utah tar sands.

It is, therefore, not surprising that the separation processes which have been successfully applied to the Athabasca tar sands have been unsuccessful in processing Utah tar sands. A few methods have been specifically developed for processing Utah tar sands and are disclosed in (1) U.S. Pat. No. 4,120,776 entitled "SEPARATION OF BITUMEN FROM DRY TAR SANDS," which patent issued on Oct. 17, 1978 to Jan D. Miller et al.; and (2) U.S. patent application Ser. No. 194,515, filed Oct. 6, 1980 by Jan D. Miller et al. for "PROCESS FOR SEPARATING HIGH VISCOSITY BITUMEN FROM TAR SANDS"; which patent and patent application are both incorporated herein by reference.

U.S. Pat. No. 4,120,776 discloses an alkaline, hot water separation process for recovering bitumen from Utah tar sands. Patent application Ser. No. 194,515, filed Oct. 6, 1980, discloses an ambient temperature grinding and flotation process for separating bitumen from sand in tar sands containing highly viscous bitumen, such as the Utah tar sands.

Peculiar Problems of the Prior Art Processes

From the foregoing discussion, it will be appreciated that the prior art processes have been concerned primarily with treating Athabasca-like or "wet" tar sands as opposed to Utah-like or "dry" tar sands. Such prior art processes for wet tar sands typically include: (1) a hot water procedure to achieve initial separation of the bitumen from the sand; (2) an upgrading procedure including a solvent addition step and a centrifugation step to remove the sand from the bitumen; and (3) a coking procedure to recover products from the bitumen. Step (2) of this typical example of the presently used processes, the upgrading step, is very expensive, but also necessary to clean up the sand-containing bitumen before subjecting the bitumen to the coking step (step 3).

Other prior art processes involve placing raw tar sand directly into a coker (e.g., a rotary kiln type process) to recover products, and recycling spent sand back into the coker to provide thermal energy. The recycle ratio of recycled spent sand to raw tar sand often approaches 9 to 1. This relatively high recycle ratio results in substantially greater materials handling problems, which in turn necessitate larger and more sophisticated equipment to handle such large quantities of materials in order to recover products from the tar sands at a reasonable rate. Such equipment is not only expensive, but often very impractical as well.

It would, therefore, be a significant advancement in the art to provide an improved process for recovering products from dry tar sands such as Utah tar sands. It would be a further advancement in the art to provide a process for recovering products from all types of tar sands wherein expensive upgrading procedures are eliminated. It would be still another advancement in the art to provide a process for recovering products from all types of tar sands wherein the amount of materials handling is minimized, thus reducing the size of equipment needed to carry out the process and increasing the processing rate for recovering products from the tar sands. Such a novel process is disclosed and claimed herein.

BRIEF SUMMARY AND OBJECTS OF THE INVENTION

The present invention relates to a novel combination physical separation process and thermal fluidized bed process for recovering hydrocarbonaceous products from tar sands. A quantity of mined tar sand is first subjected to a physical separation process or beneficiation process in which a portion of the sand is removed, yielding a bitumen-rich concentrate containing from about fifteen percent (15%) to about eighty percent (80%) bitumen by weight, the remainder comprising primarily sand.

The physical separation process thus acts as a beneficiation process to remove only a portion of the sand from the tar sand, with the resulting bitumen-rich concentrate containing a significant amount of sand. According to several different embodiments of the present invention, the physical separation process comprises either: (1) an alkaline, hot water separation process; (2) a solvent extraction process; (3) an ambient temperature grinding and flotation process; or (4) combinations of processes (1)–(3).

The bitumen-rich concentrate is then introduced directly into a fluidized bed (without first being subjected to any upgrading procedures) where it is heated to a temperature within the range of between about 400° C. and about 600° C. for between about two to about forty minutes. The precise temperature of the fluidized bed, the retention time of the bitumen-rich concentrate within the fluidized bed, and the particle size of the constituents comprising the fluidized bed may be adjusted according to the types and ratios of products desired to be obtained from this process.

The hydrocarbonaceous products formed in the fluidized bed are recovered, leaving a coked sand (sand having a carbonaceous residue thereon) which is removed from the fluidized bed and placed into a combustor. The recovered hydrocarbonaceous products may then be distilled into their respective fractions. The carbonaceous residue is burned in the combustor, thereby increasing the temperature of the sand by the heat of combustion to produce a hot burnt sand.

Other embodiments of the novel process of the present invention include several recycling steps, any combination of which may be used to improve the efficiency of the process. The first recycling step of the present invention involves recycling a portion of the coked sand to the physical separation process (especially when the physical separation process is an alkaline, hot water separation process) both to provide thermal energy to the physical separation process and to enhance the efficiency of the separation achieved therein. The second recycling step involves recycling a portion of the hot burnt sand to the bitumen-rich concentrate and/or to the fluidized bed to provide thermal energy to the bitumen-rich concentrate in the fluidized bed and to provide adequate surface area for receiving the carbonaceous residue formed in the fluidized bed. The third recycling step involves recycling a portion of the fraction obtained during distillation of the recovered products within the temperature range of between about 140° C. and about 370° C. to the physical separation process to enhance the efficiency of the separation achieved therein.

It is, therefore, an object of the present invention to provide an improved process for separating bitumen from dry tar sands such as Utah tar sands and for recovering products from such tar sands.

It is another object of the present invention to provide a process for recovering products from all types of tar sands wherein expensive upgrading procedures are eliminated.

A further object to the present invention is to provide a process for recovering products from all types of tar sands wherein the amount of materials handling is minimized, thus reducing the costs of carrying out the process while increasing the processing rate for recovering products from the tar sands.

It is still another object of the present invention to provide a process for recovering products from tar sands wherein the efficiency of the process may be enhanced by employing one or more of a plurality of recycling steps.

These and other objects and features of the present invention will become more fully apparent from the following description and appended claims, taken in conjunction with the accompanying drawings.

DETAILED DESCRIPTION OF THE PREFERRED EMBODIMENTS

Figure 1:
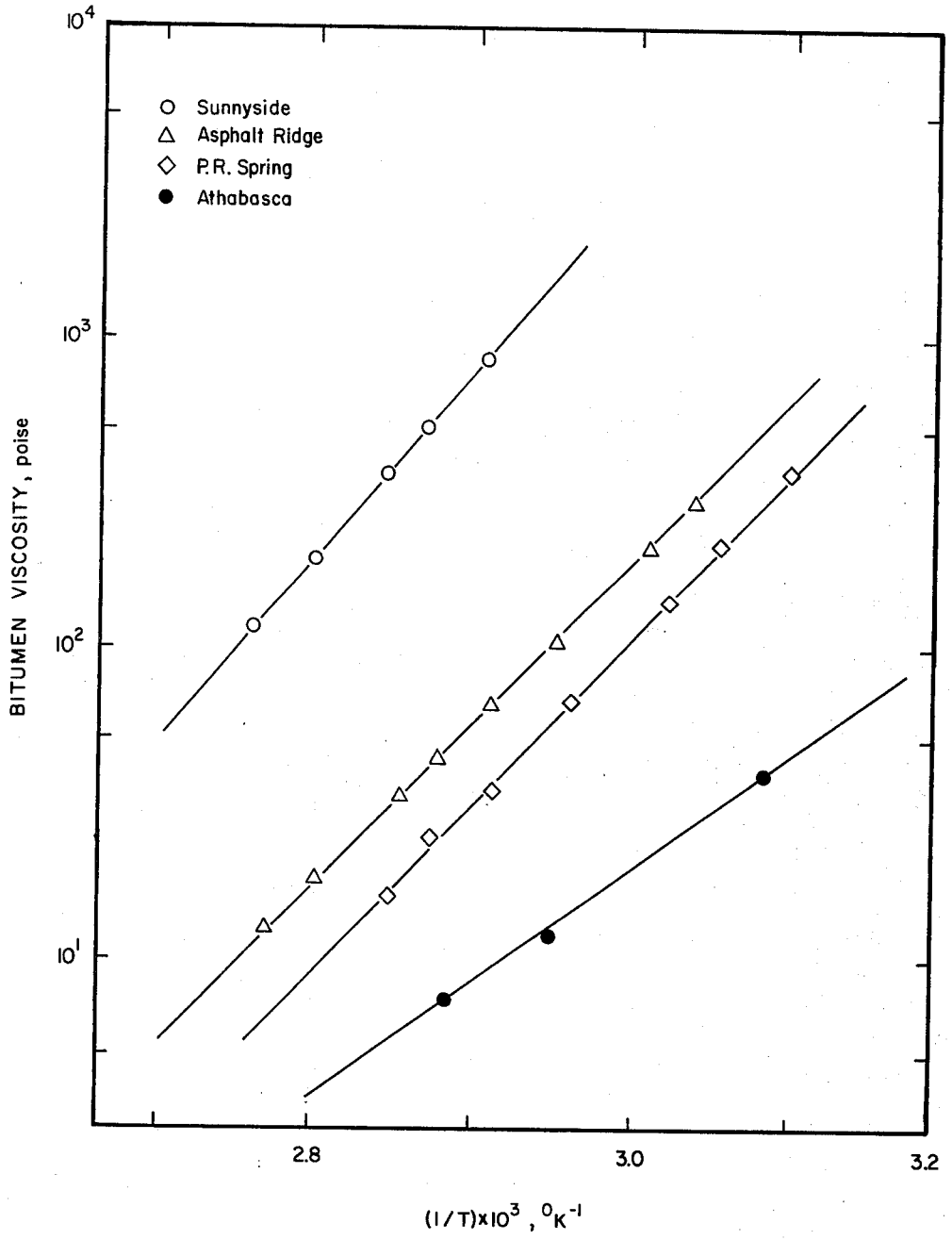
FIG. 1 illustrates the differences in viscosity between Athabasca tar sands and Utah tar sands (Sunnyside, Asphalt Ridge, and P.R. Spring tar sand deposits being representative of Utah tar sands). The graph of FIG. 1 is an Arrhenius-type plot illustrating the effect of temperature on the bitumen viscosity of Utah tar sands and Athabasca tar sands.
Figure 2:
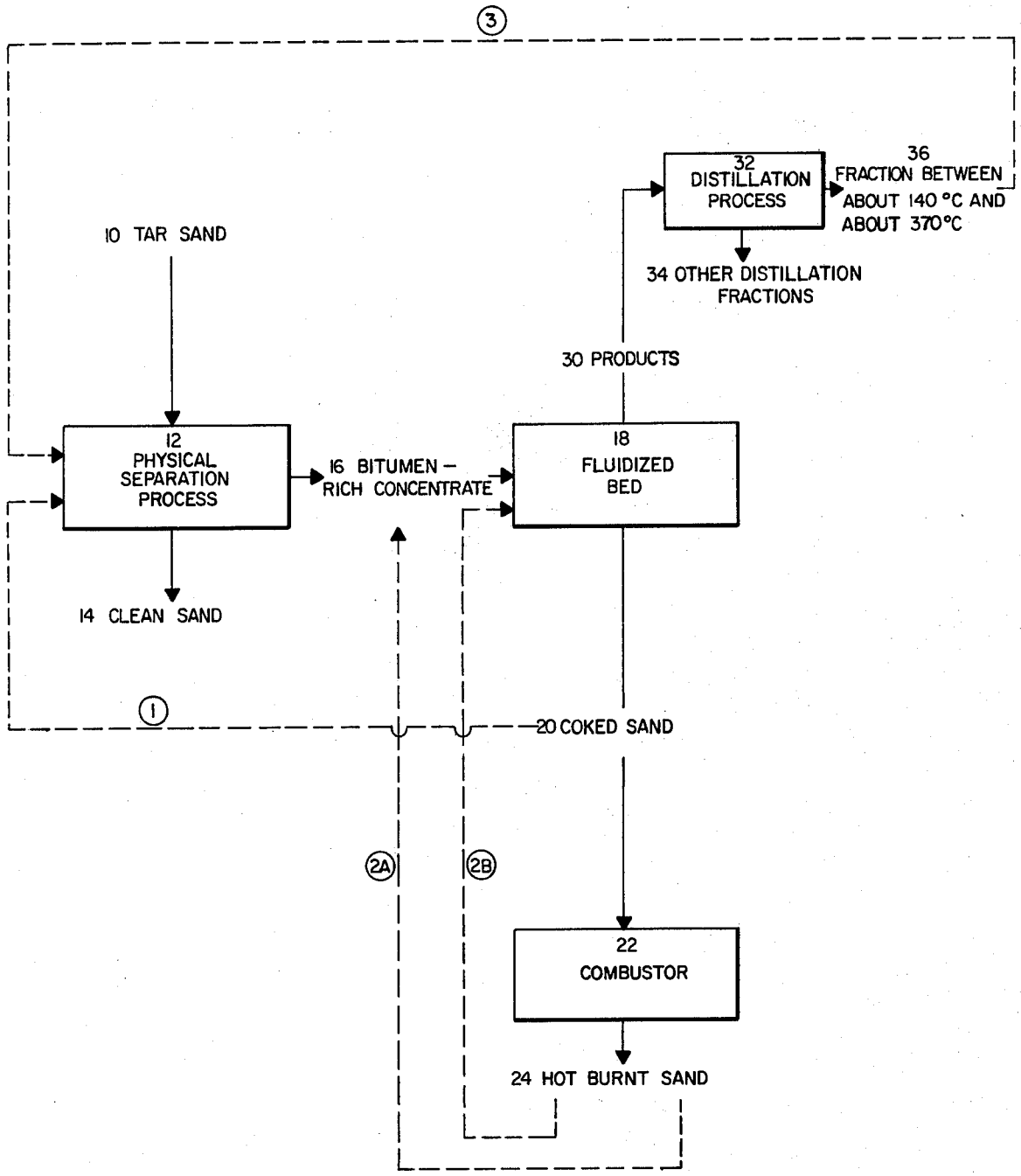
FIG. 2 is a block flow diagram of the novel process of the present invention.

The present invention will be better understood by making reference to FIG. 2 of the accompanying drawings.

The present invention comprises a combination physical separation process and thermal fluidized bed process for recovering hydrocarbonaceous products from tar sands. The tar sand 10 to be treated (preferably first reduced in size) is introduced into a physical separation process 12 wherein the bitumen is separated from the sand. A portion of the sand is then removed from the bitumen/sand mixture, thereby yielding a bitumen-rich concentrate 16. During the physical separation process 12, a quantity of relatively clean sand 14 is removed from the tar sand 10. At this stage of the processing, bitumen-rich concentrate 16 generally contains from about 15% bitumen and about 85% sand by weight to about 80% bitumen and about 20% sand by weight. As discussed in greater detail hereinafter, bitumen-rich concentrate 16 is then introduced directly into a fluidized bed (without first being subjected to an upgrading procedure) wherein the hydrocarbonaceous products are formed.

The physical separation process 12 is thus best characterized as a beneficiation process (since there is still a significant quantity of sand remaining in the bitumen-rich concentrate) rather than a process for completely removing the sand from the bitumen before recovering products from the bitumen, as is generally true of the prior art processes. Any physical separation process which will yield the bitumen-rich concentrate described herein may be employed in the process of the present invention.

One such physical separation process is the alkaline, hot water separation process disclosed in U.S. Pat. No. 4,120,776, which is particularly suited for the treatment of dry tar sands, such as Utah tar sands. In this process, the tar sands are first comminuted to an average particle size of approximately one centimeter in diameter. Next, the comminuted tar sand is digested in a hot aqueous solution having a pH within the range of about eight (pH 8) to about eleven (pH 11). Separation of the bitumen from the sand may be optimized by maintaining the proportion of tar sand solids in the digester within the range of between about 50% and about 80%, thereby providing the necessary high shear environment to obtain such separation. Subsequently, the digested tar sand is subjected to a flotation process wherein additional water is introduced to dilute the concentration of solids, and air is bubbled into the mixture to carry the separated bitumen particles to the top of the flotation cell. The resultant product of this process is a bitumen-rich concentrate, containing up to 70% or more bitumen by weight, which can be introduced into the fluidized bed for processing.

Another physical separation process which may be used in the process of the present invention is a modified solvent extraction process. A large number of solvent extraction processes have heretofore been developed in the art for extracting bitumen from tar sand. See, for example, U.S. Pat. No. 4,036,732 which issued on July 19, 1977, to Irani et al., and U.S. Pat. No. 4,229,281 which issued on Oct. 21, 1980, to Alquist et al.

Typically, the prior art solvent extraction processes involve comminuting the tar sand and contacting the tar sand with about two to ten parts of solvent per part of bitumen present in the tar sand. Once the bitumen has been extracted by the solvent, the prior art processes have been faced with two significant problems: (1) removing the sand from the extracted bitumen and solvent, and (2) recovering the solvent in the bitumen-containing solvent as well as the solvent remaining in the sand. Generally, the sand is removed from the bitumen-containing solvent by filtration or centrifugation. The solvent can be removed from the sand by heating or extracting with water; the solvent is recovered from the bitumen-containing solvent by traditional distillation techniques.

The foregoing procedures presently used in the art to remove the sand and recover the solvent impose a substantial cost burden on the overall extraction process. One embodiment of the present invention avoids these costs by using a modified solvent extraction process which eliminates, to a large extent, the expensive steps involved in removing the sand and recovering the solvent.

In the modified solvent extraction process of the present invention, the tar sand is first comminuted and then contacted with a solvent much in the same way as the prior art processes. In one application of this process, the tar sand is initially crushed and introduced into the first of several mixing stages. A solvent containing paraffinic hydrocarbons, and preferably aromatic hydrocarbons as well, is first introduced into the last of the mixing stages so as to contact the incoming tar sand in a counter-current fashion, that is, the solvent moves in the direction opposite to that of the tar sand. The number of stages may be adjusted so as to ensure adequate extraction. The resulting bitumen-rich solvent exits the first stage of the multi-stage process, while the solvent-wet sand is discharged from the last stage thereof.

The bitumen-rich solvent corresponds to the bitumen-rich concentrate of the present invention and contains a significant amount of sand. Instead of employing the expensive sand removing techniques of the prior art processes, the bitumen-rich solvent is introduced directly into the fluidized bed of the present invention without first removing the sand. The solvent in the bitumen-rich solvent is recovered with the rest of the products which are formed by heating the bitumen in the fluidized bed.

Thus, by using the novel modified solvent extraction process, the necessity and expense of completely removing the sand from the bitumen before recovering products from the bitumen is eliminated. Moreover, the expense of an additional step to recover the solvent from the bitumen-rich solvent is eliminated by recovering the solvent during the heating procedure in the fluidized bed. If desired, the solvent remaining in the discharged solvent-wet sand can also be recovered through a flashing process in which the latent heat of vaporization is supplied by the hot burnt sand withdrawn from the combustor; the solvent being recycled for subsequent reuse in the solvent extraction process.

Thus, although the present invention provides a process for completely avoiding the solvent extraction procedures and solvent upgrading procedures of the prior art, one embodiment of the present invention also provides an improved solvent extraction process which eliminates many of the costly aspects of the prior art extraction procedures. As discussed hereinabove, this is done by using the solvent extraction process as a beneficiation process to produce a bitumen-rich concentrate, and not as a complete upgrading process to remove all sand from the resulting bitumen-containing solvent.

Still another physical separation process which may be used in the process of the present invention is an ambient temperature grinding and flotation process. U.S. patent application Ser. No. 194,515, filed Oct. 6, 1980, discloses an ambient temperature grinding and flotation process which is especially suited for the treatment of highly viscous tar sands such as Utah tar sands. This process comprises a step of mechanically grinding the tar sand to obtain phase disengagement of the highly viscous bitumen from the sand, and a flotation step to obtain phase separation of the bitumen phase from the sand phase. Phase disengagement is assisted by using a suitable wetting agent (such as sodium carbonate) during the grinding step, while the phase separation step is assisted by the inclusion of a promoter oil (such as fuel oil or kerosene) to enhance flotation. The resultant product of this process is a bitumen-rich concentrate, containing up to 20% or more bitumen by weight, which can be introduced into the fluidized bed for processing.

It will be recognized that the bitumen-rich concentrate of the present invention may be obtained by using one or more of the above-described physical separation processes alone or in combination, and that any other suitable physical separation processes may be used singly or in combination with the above-described physical separation processes.

As mentioned previously, the bitumen-rich concentrate generally comprises a bitumen/sand mixture containing from about 15% bitumen and about 85% sand by weight to about 80% bitumen and about 20% sand by weight. The exact composition of the bitumen-rich concentrate varies according to the physical separation process used. The presently preferred range for the bitumen-rich concentrate is from about 25% bitumen and about 75% sand by weight to about 55% bitumen and about 45% sand by weight, with the presently most preferred proportions for the bitumen-rich concentrate being about 40% bitumen and about 60% sand by weight.

The foregoing optimum ranges for the composition of the bitumen-rich concentrate were derived by placing an emphasis on the thermal energy considerations of the process of the present invention. If other considerations are deemed important, the optimum ranges may be significantly different. For example, if the production of certain specific hydrocarbonaceous products is an important consideration in one application of the novel process, it is possible that the composition of the bitumen-rich concentrate would have to be altered so as to favor the production of those hydrocarbonaceous products. Moreover, since the different physical separation processes yield significantly different compositions of bitumen-rich concentrate, it will be appreciated that by combining the bitumen-rich concentrates obtained from the different physical separation processes disclosed herein, the bitumen/sand ratio of the bitumen-rich concentrate can be carefully controlled to maintain that ratio within the optimum range.

It should also be recognized that the term "bitumen-rich concentrate," as used herein, means either a relatively dry mixture of sand and bitumen, or a bitumen/sand mixture containing a certain amount of water. Thus, the given percentages for the composition of the bitumen-rich concentrate may have to be altered somewhat to account for the water present in a wet bitumen-rich concentrate. The ambient temperature grinding and flotation process generally yields a relatively dry bitumen-rich concentrate, while the alkaline, hot water separation process generally yields a relatively wet bitumen-rich concentrate. Moreover, as explained previously, the bitumen-rich concentrate produced in the modified solvent extraction process contains a significant amount of solvent. Thus, the presence of water or solvent in the bitumen-rich concentrate does not prohibit its usefulness in the process of the present invention.

The bitumen-rich concentrate 16, whether obtained by one of the aforementioned physical separation processes or combinations thereof, is introduced into a fluidized bed 18 where it is heated to a temperature within the range of between about 400° C. and about 600° C. for a residency time of between about two (2) to about forty (40) minutes. The fluidized bed is maintained by well-known techniques, such as by introducing a fluidizing gas (for example, effluent gas from the combustor) into the bed. It will be readily recognized that the precise temperature of the fluidized bed, the retention time of the bitumen-rich concentrate within the fluidized bed, and the particle size of the constituents comprising the fluidized bed may be adjusted according to the types and ratios of products which are desired. A detailed discussion of the effect of various temperatures, retention times, and particle sizes is found in our copending application, Ser. No. 155,257, filed June 2, 1980.

Hydrocarbonaceous products 30 formed in the fluidized bed 18 are recovered, leaving behind a coked sand 20 (sand having a carbonaceous residue thereon) which is removed from the fluidized bed and placed into a combustor 22. In the combustor, the carbonaceous residue on the coked sand 20 is burned, thereby releasing heat during the combustion process and producing a hot burnt sand 24. The temperature of the combustor 22 is generally maintained within the range of between about 480° C. and about 925° C., with the presently preferred range being between about 565° C. and about 790° C.

The hydrocarbonaceous products 30 which are recovered from the fluidized bed are routed to a conventional distillation process 32 where they are distilled into their respective fractions 34 and 36.These distilled products may then be further upgraded to produce other hydrocarbon products as desired.

The novel process of the present invention includes a number of recycling steps, any combination of which may be used in conjunction with the novel process as desired. These recycling steps are illustrated in FIG. 2 by dashed lines and are identified by the following numerals in parentheses: (1) recycling a portion of the coked sand 20 to the physical separation process 12; (2A) recycling a portion of hot burnt sand 24 to the bitumen-rich concentrate 16 and/or (2B) recycling a portion of the hot burnt sand to fluidized bed 18; and (3) recycling a certain distillation fraction 36 back to the physical separation process.

Recycling step 1 involves recycling a portion of the coked sand 20 to the physical separation process 12 to provide thermal energy for the physical separation process and to enhance the efficiency of the separation achieved therein. Recycling step 1 has found particular utility in the embodiment where the alkaline, hot water separation process is employed in the physical separation process. It will be recognized that recycling step 1 can be accomplished by recycling a portion of coked sand 20 to the mined tar sand and/or directly to the physical separation process.

Recycling the coked sand back into the alkaline, hot water separation process synergistically assists the phase disengagement of the bitumen from the sand. While the exact reason for this surprising result is not clearly understood, it is believed that the hydrophobic and oleophilic nature of the carbonaceous residue on the coked sand aids in achieving phase disengagement of the bitumen from the sand. It is further believed that relatively coarser sand particles in the coked sand contribute to the separation efficiency by displacing finer sand particles in the tar sand feed. This, in turn, would result in a higher ratio of coarser sand particles in the bitumen-rich concentrate which would enhance the thermal processing of the bitumen-rich concentrate in the fluidized bed.

Recycling steps 2A and 2B involve recycling a portion of the hot burnt sand 24 to the bitumen-rich concentrate 16 and/or to the fluidized bed 18. In the fluidized bed, the hot burnt sand provides two important functions: (1) it provides thermal energy for the bitumen-rich concentrate in the fluidized bed, and (2) it provides a surface upon which the carbonaceous residue produced during the processing of the bitumen in the fluidized bed may form. This is achieved by recycling hot burnt sand 24 to either the bitumen-rich concentrate (recycling step 2A) or directly to the fluidized bed (recycling step 2B) or both.

Although recycling the hot burnt sand greatly enhances the efficiency of the novel process of the present invention, it is also desirable to minimize the amount of hot burnt sand to be recycled so as to minimize the cost of materials handling. Thus, enough hot burnt sand should be recycled to the bitumen-rich concentrate in the fluidized bed to provide the necessary thermal energy and to supply the necessary surface area for receiving the carbonaceous residue produced in the fluidized bed, but the amount of hot burnt sand recycled should not be so large that the cost of materials handling becomes significant or even prohibitive.

Determining the optimum amount of hot burnt sand to be recycled depends largely upon the bitumen/sand composition of the bitumen-rich concentrate and is often expressed in terms of the so-called "recycle ratio". The recycle ratio may be defined as the ratio of the recycled, hot burnt sand to the bitumen-rich concentrate introduced into the fluidized bed. The recycle ratio must be high enough to provide adequate thermal energy for the bitumen-rich concentrate in the fluidized bed and to provide adequate surface area to receive the carbonaceous residue formed in the fluidized bed; yet minimizing the recycle ratio is desirable in terms of materials handling.

As the proportion of bitumen in the bitumen-rich concentrate increases, the recycle ratio must necessarily also be increased to provide additional surface area for the carbonaceous residue which is formed in the fluidized bed. If the concentration of bitumen in the bitumen-rich concentrate is increased but the recycle ratio is not, there may be an insufficient amount of surface area on the hot burnt sand to receive the carbonaceous residue formed in the fluidized bed. In the absence of a sufficient quantity of hot burnt sand to receive the carbonaceous residue, it is believed that the particle constituents of the fluidized bed will begin to adhere to each other and that the resulting agglomeration may inhibit or even prevent the operation of the fluidized bed.

The recycle ratio is of further importance in that the higher the recycle ratio, the lower the ratio of carbonaceous residue to sand in coked sand 20 which is removed from the fluidized bed. The carbonaceous residue/sand ratio of the coked sand 20 becomes important when the coked sand is subsequently burned in combustor 22. Since the carbonaceous residue/sand ratio of the coked sand will affect the temperature of the combustor, the carbonaceous residue/sand ratio should be high enough to produce a hot burnt sand 24 with the desirable amount of thermal energy, yet low enough to keep the combustor from becoming overheated or inoperational.

To maintain the temperature of the combustor between about 480° C. and about 925° C., the proportion of carbonaceous residue in the coked sand should be within the range of between about 0.5% and about 5% carbonaceous residue by weight. The presently preferred range for the proportion of carbonaceous residue in the coked sand is between about 0.5% and about 3% carbonaceous residue by weight, with the presently most preferred range being between about 0.8% and about 1.5% carbonaceous residue by weight. It will be appreciated, however, that the exact optimum carbonaceous residue/sand ratio will depend in part upon the design, heat capacity, and heat loss characteristics of the combustor.

From the foregoing, it will be appreciated that the recycle ratio of hot burnt sand 24 to bitumen-rich concentrate 16, the carbonaceous residue/sand ratio of the coked sand 20 removed from the fluidized bed 18, and the composition of the bitumen-rich concentrate 16 are interdependent in optimizing the overall efficiency of the process of the present invention.

The following example illustrates the optimum parameters which were obtained in one particular application of the present invention. In this experiment, tar sand from the Sunnyside deposit in Utah, having a composition of about 8–12% bitumen and about 88–92% sand by weight, was subjected to the alkaline, hot water separation process which produced a bitumen-rich concentrate 16 having about 40% bitumen and about 60% sand by weight. The bitumen-rich concentrate was then introduced into a fluidized bed having a heat-loss factor of about 5%. Products were recovered from the fluidized bed and the coked sand formed in the fluidized bed was removed and placed in a combustor having a 10% heat-loss factor. For experimental convenience, a portion of unheated sand was recycled back into the fluidized bed in sufficient quantities to provide a recycle ratio within the range of about 2–3 to 1.

This recycle ratio of 2–3 to 1 provided adequate sand to receive the carbonaceous residue formed in the fluidized bed, while maintaining the amount of recycled sand at a minimum. The resulting carbonaceous residue/sand ratio of the coked sand removed from the fluidized bed was such that the coked sand comprised about 0.8% to about 1.5% carbonaceous residue by weight. This percentage of carbonaceous residue in the coked sand provided a temperature within the range of between about 565° C. and about 790° C. in the combustor. Moreover, the recycled sand did not significantly inhibit the recovery of products from the fluidized bed. (It will be readily appreciated that although unheated sand was recycled in the experiment for convenience, it is more desirable to recycled the hot burnt sand from the combustor so as to provide thermal energy to the bitumen-rich concentrate in the fluidized bed.)

It will be recognized that the foregoing experiment is given by way of example only, and that the optimal parameters for the recycle ratio, the carbonaceous residue/sand ratio, and the composition of the bitumen-rich concentrate will vary according to each individual application.

The physical separation process or beneficiation process initially removes a significant portion of the sand in the tar sand, with the result that not as much hot burnt sand 24 needs to be recycled to provide thermal energy to the bitumen-rich concentrate produced. This is in contrast to the prior art processes which recycled the hot burnt sand directly to the mined tar sand without the benefit of a beneficiation process to first dispose of a portion of the sand before the recycling step.

Recycling step 3 involves recycling a portion of a certain fraction 36 obtained during distillation 32 of recovered products 30, namely, the fraction comprising the heavy naptha and kerosene fractions. This recycling step has found particular utility in the embodiments where the physical separation process 12 is either the alkaline, hot water separation process or the solvent extraction process or combinations of the two. The presently preferred range for recycled fraction 36 is that fraction obtained during distillation between about 140° C. and about 370° C.

Advantageously, the recycled fraction acts to penetrate the bitumen of the tar sand in the physical separation process so as to reduce the viscosity of the bitumen. It will be recognized that recycling step 3 can be accomplished by recycling fraction 36 to the mined tar sand and/or directly to the physical separation process.

In choosing a particular fraction to recycle to the physical separation process, it is important that the fraction not be so volatile as to be flashed off in the alkaline, hot water separation process or solvent extraction process, and yet not be so heavy that it is incapable of penetrating the bitumen in the tar sand. The fraction obtained during distillation between 140° C. and 370° C. presently appears to best meet these criteria. Thus, recycled fraction 36 acts to enhance the separation efficiency of both the alkaline, hot water separation process and the solvent extraction process by penetrating the bitumen and reducing the viscosity thereof, thereby enhancing separation of the bitumen from the sand.

It should be recognized that numerous permutations and combinations of the foregoing recycling steps may be used in the process of the present invention, in combination with a variety of physical separation processes. It will thus be appreciated that the invention may be embodied in other specific forms without departing from its spirit or essential characteristics. The described embodiments are to considered in all respects only as illustrative and not restrictive. The scope of the invention is, therefore, indicated by the appended claims rather than by the foregoing description. All changes which come within the meaning and range of equivalency of the claims are to embraced within their scope.

What is claimed and desired to be secured by United States Letters Patent is:

1. A process for recovering products from tar sand comprising the steps of:

obtaining a tar sand;

processing the tar sand to produce a bitumen-rich concentrate, said bitumen-rich concentrate comprising from about 15% bitumen and and 85% sand by weight to about 80% bitumen and about 20% sand by weight; and recovering products from the bitumen-rich concentrate by introducing the bitumen-rich concentrate into a fluidized bed while heating the bitumen-rich concentrate in the fluidized bed.

2. A process for recovering products from tar sand as defined in claim 1 further comprising the steps of:

removing a coked sand from the fluidized bed, said coked sand comprising sand having a carbonaceous residue thereon;

burning at least a portion of the carbonaceous residue on the coked sand to produce a hot burnt sand; and recycling at least a portion of the hot burnt sand to the bitumen-rich concentrate.

3. A process for recovering products from tar sand as defined in claim 1 further comprising the steps of:

removing a coked sand from the fluidized bed, said coked sand comprising sand having a carbonaceous residue thereon;

burning at least a portion of the carbonaceous residue on the coked sand to produce a hot burnt sand; and recycling at least a portion of the hot burnt sand to the fluidized bed.

4. A process for recovering products from tar sand as defined in claim 2 wherein a sufficient quantity of hot burnt sand is recycled such that the coked sand removed from the fluidized bed contains carbonaceous residue in the range of between about 0.5% and about 5% by weight.

5. A process for recovering products from tar sand as defined in claim 2 wherein a sufficient quantity of hot burnt sand is recycled to the fluidized bed such that the coked sand removed from the fluidized bed contains carbonaceous residue in the range of about 0.8% to about 1.5% by weight.

6. A process for recovering products from tar sand as defined in claim 2 wherein the ratio of recycled hot burnt sand to bitumen-rich concentrate introduced into the fluidized bed is within the range of about 2:1 to about 3:1.

7. A process for recovering products from tar sand as defined in claim 2 wherein the carbonaceous residue is burned at a temperature within the range of between about 480° C. and about 925° C.

8. A process for recovering products from tar sand as defined in claim 2 wherein the carbonaceous residue is burned at a temperature within the range of between about 565° C. and about 790° C.

9. A process for recovering products from tar sand as defined in claim 1 wherein the tar sand is processed by an alkaline, hot water separation process to produce the bitumen-rich concentrate.

10. A process for recovering products from tar sand as defined in claim 9, further comprising the steps of:

removing a coked sand from the fluidized bed, said coked sand comprising sand having a carbonaceous residue thereon; and recycling at least a portion of the coked sand to the alkaline, hot water separation process.

11. A process for recovering products from tar sand as defined in claim 9 further comprising the steps of:

distilling the recovered products;

isolating a fraction formed during distillation within the temperature range of about 140° C. to about 370° C.; and recycling the isolated fraction to the alkaline, hot water separation process.

12. A process for recovering products from tar sand as defined in claim 1 wherein the tar sand is processed by a solvent extraction process to produce the bitumen-rich concentrate.

13. A process for recovering products from tar sand as defined in claim 12 further comprising the steps of:

distilling the recovered products;

isolating a fraction formed during distillation within the temperature range of about 140° C. to about 370° C.; and recycling the isolated fraction to the solvent extraction process.

14. A process for recovering products from tar sand as defined in claim 1 wherein the tar sand is processed by an ambient temperature grinding and flotation process to produce the bitumen-rich concentrate.

15. A process for recovering products from tar sand as defined in claim 1 wherein the processing step further comprises:

obtaining a first portion of the bitumen-rich concentrate from an alkaline, hot water separation process;

obtaining a second portion of the bitumen-rich concentrate from an ambient temperature grinding and flotation process; and combining the two portions of the bitumen-rich concentrate.

16. A process for recovering products from tar sand as defined in claim 1 wherein the processing step further comprises:

obtaining a first portion of the bitumen-rich concentrate from a solvent extraction process;

obtaining a second portion of the bitumen-rich concentrate from an ambient temperature grinding and flotation process; and combining the two portions of the bitumen-rich concentrate.

17. A process for recovering products from tar sand as defined in claim 1 wherein the bitumen-rich concentrate comprises from about 25% bitumen and about 75% sand by weight to about 55% bitumen and about 45% sand by weight.

18. A process for recovering products from tar sand as defined in claim 1 wherein the bitumen-rich concentrate comprises about 40% bitumen by weight and about 60% sand by weight.

19. A process for recovering products from tar sand comprising the steps of:

obtaining a tar sand;

processing the tar sand to produce a bitumen-rich concentrate, said bitumen-rich concentrate comprising from about 25% bitumen and about 75% sand by weight to about 55% bitumen and about 45% sand by weight;

recovering products from the bitumen-rich concentrate by introducing the bitumen-rich concentrate into a fluidized bed while heating the bitumen-rich concentrate in the fluidized bed;

removing a coked sand from the fluidized bed, said coked sand comprising sand having a carbonaceous residue thereon;

burning at least a portion of the carbonaceous residue on the coked sand to produce a hot burnt sand; and recycling at least a portion of the hot burnt sand to the bitumen-rich concentrate.

20. A process for recovering products from tar sand as defined in claim 19 wherein the tar sand is processed by an alkaline, hot water separation process to produce the bitumen-rich concentrate; the process further comprising:

recycling at least a portion of the coked sand to the alkaline, hot water separation process.

21. A process for recovering products from tar sand as defined in claim 20 wherein the ratio of recycled hot burnt sand to bitumen-rich concentrate introduced into the fluidized bed is within the range of about 2:1 to about 3:1.

22. A process for recovering products from tar sand as defined in claim 20 further comprising the steps of:

distilling the recovered products;

isolating a fraction formed during distillation within the temperature range of about 140° C. to about 370° C.; and recycling the isolated fraction to the alkaline, hot water separation process.

23. A process for recovering products from tar sand as defined in claim 22 wherein the processing step further comprises obtaining at least a portion of the bitumen-rich concentrate from an ambient temperature grinding and flotation process and combining said portion with the bitumen-rich concentrate obtained in the alkaline, hot water separation process.

24. A process for recovering products from tar sand as defined in claim 19 wherein the tar sand is processed by a solvent extraction process to produce the bitumen-rich concentrate; the process further comprising the steps of:

distilling the recovered products;

isolating a fraction formed during distillation within the temperature range of about 140° C. to about 370° C.; and recycling the isolated fraction to the solvent extraction process.

25. A process for recovering products from tar sand as defined in claim 24 wherein the processing step further comprises obtaining at least a portion of the bitumen-rich concentrate from an ambient temperature grinding and flotation process and combining said portion with the bitumen-rich concentrate obtained in the solvent extraction process.

26. A process for recovering products from tar sand as defined in claim 19 wherein a sufficient quantity of hot burnt sand is recycled to the bitumen-rich concentrate such that the coked sand removed from the fluidized bed contains conbonaceous residue in the range of between about 0.5% and about 5% by weight and wherein the burning step is conducted at a temperature within the range of between about 480° C. and about 925° C.

27. A process for recovering products from tar sand as defined in claim 19 wherein a sufficient quantity of hot burnt sand is recycled to the bitumen-rich concentrate such that the coked sand removed from the fluidized bed contains carbonaceous residue in the range of between about 0.8% and about 1.5% by weight and wherein the burning step is conducted at a temperature within the range of between about 565° C. and about 790° C.

28. A process for recovering products from tar sand comprising the steps of:

obtaining a tar sand;

preparing a bitumen-rich concentrate from the tar sand using an alkaline, hot water separation process, said bitumen-rich concentrate comprising from about 35% bitumen and about 65% sand by weight to about 45% bitumen and about 55% sand by weight;

recovering products from the bitumen-rich concentrate by introducing the bitumen-rich concentrate into a fluidized bed while heating the bitumen-rich concentrate in the fluidized bed;

removing a coked sand from the fluidized bed, said coked sand comprising sand having a carbonaceous residue thereon;

recycling at least a portion of the coked sand to the alkaline, hot water separation process;

burning the carbonaceous residue on at least a portion of the coked sand to produce a hot burnt sand;

recycling at least a portion of the hot burnt sand to the bitumen-rich concentrate;

distilling the recovered products;

isolating a fraction formed during distillation within the temperature range of about 140° C. to about 370° C.; and recycling the isolated fraction to the alkaline, hot water separation process.

29. A process for recovering products from tar sand as defined in claim 1 wherein the bitumen-rich concentrate is retained in the fluidized bed for about 2 to about 40 minutes and heated to a temperature of about 400° C. to about 600° C.

30. A process for recovering products from tar sand as defined in claim 19 wherein the bitumen-rich concentrate is retained in the fluidized bed for about 2 to about 40 minutes and heated to a temperature of about 400° C. to about 600° C.

* * * * *

UNITED STATES PATENT AND TRADEMARK OFFICE

CERTIFICATE OF CORRECTION

PATENT NO. : 4,409,090

DATED : October 11, 1983

INVENTOR(S) : Francis V. Hanson, et al.

It is certified that error appears in the above—identified patent and that said Letters Patent is hereby corrected as shown below:

Column 2, line 6, "Cameron Engineering, Inc., Denver, Colorado" should not be italicized Column 2, line 68, "sands substantially" should be --sands is substantially--

Column 11, line 32, "recycled" should be --recycle--

Column 12, line 24, "to embraced" should be --to be embraced--

Column 15, line 12 (claim 26) "conbonaceous" should be --carbonaceous--

Signed and Sealed this

*Seventh* Day of *August 1984*

[SEAL]

*Attest:*

GERALD J. MOSSINGHOFF

*Attesting Officer*

*Commissioner of Patents and Trademarks*